US005860233A

United States Patent [19]

Roubinet

[11] Patent Number: 5,860,233

[45] Date of Patent: Jan. 19, 1999

[54] VALVE CONFIGURATION AND MOUNTING ARRANGEMENT

[75] Inventor: Christophe Roubinet, Beaucroissant, France

[73] Assignee: Caterpillar Inc., Peoria, Ill.

[21] Appl. No.: 843,174

[22] Filed: Apr. 14, 1997

[51] Int. Cl.[6] ..... E02F 3/00

[52] U.S. Cl. ..... 37/466; 414/680

[58] Field of Search ..... 37/466, 443, 468, 37/902, 347; 414/694, 680, 700; 91/445, 446, 447, 420

[56] References Cited

U.S. PATENT DOCUMENTS

| | | | |
|---|---|---|---|
| 3,938,669 | 2/1976 | Vinton | 414/718 X |
| 3,987,920 | 10/1976 | Parquet et al. | 414/700 X |
| 4,165,675 | 8/1979 | Cryder et al. | 91/420 |
| 4,365,429 | 12/1982 | Ecker et al. | 37/443 |
| 4,393,607 | 7/1983 | Hirosawa | 37/443 |
| 4,411,070 | 10/1983 | Boyum et al. | 414/694 X |

OTHER PUBLICATIONS

Case Skid Steer 1840/1845C brochure, pp. 1–20, Jun. 1995.

*Primary Examiner*—Thomas B. Will
*Assistant Examiner*—Victor Batson
*Attorney, Agent, or Firm*—William C. Perry

[57] ABSTRACT

Construction machines typically utilize hydraulic cylinders to manipulate the linkage that extends between the machine frame and a work implement. In many instances the range of motion of the components creates limited room between the components when they are in their maximum positions. This limited room has prevented the direct attachment of valves to the various hydraulic cylinders. The present invention provides a valve that has a preselected angled configuration that substantially matches a preselected angled configuration of a surrounding frame member. When the linkage is in one of its extreme positions, the two preselected configurations of the valve and the frame member "nest" with one another to prevent contact therebetween, thus allowing the use of the available space.

7 Claims, 2 Drawing Sheets

VALVE CONFIGURATION AND MOUNTING ARRANGEMENT

TECHNICAL FIELD

This invention relates to a valve arrangement and more particularly to a valve having a preselected configuration that is mounted to a fluid cylinder that is pivotally mounted for movement in close proximity to surrounding frame members.

BACKGROUND ART

In present day construction machines, such as a hydraulic excavator for example, the use of hydraulic cylinders to manipulate a work implement is quite common. A typical excavator includes a boom member that is pivotally connected to a frame of the machine, a secondary boom member, or stick, that is pivotally mounted to the boom, and a work implement that is pivotally mounted to a distal end of the stick. A hydraulic cylinder or a pair of hydraulic cylinders, depending on the size of the machine, are mounted between the frame and the boom member to move the boom member up and down with respect to the frame. At least one more hydraulic cylinder is positioned between the stick and the boom to move the stick with respect to the boom and the machine. Yet another hydraulic cylinder is positioned between the stick and the work implement to rotate the implement with respect to the stick. It is quite common for the hydraulic pressure requirements, especially in the boom and stick cylinders, to be quite high since it requires great force to manipulate the implement.

In many countries, especially those in Europe, there exist regulations, such as European Regulation ISO 8643, that require a load check valve to be connected to the pressurized end of the various cylinders to prevent the movement of the cylinders in the unlikely event that communication of the pressurized fluid to the cylinders is interrupted. Even more strict regulations require that this valve be connected directly to the cylinders without fluid conduits interposed therebetween. While this may seem to be a requirement that is relatively easy to satisfy, the movements and close proximity of the various components of an excavator make this an extremely difficult task, especially in the area of the boom. The reason for this stems from the positioning of both the lower portion of the boom and the hydraulic cylinder(s) on the forward portion of the frame. Since these members are massive and transmit great forces into the frame, there must be substantial reinforcement of the frame in this area. The reinforcement members must be in such close proximity to the boom and the stick cylinders, it is a very difficult to mount a valve directly on the boom cylinders without interfering with the frame or boom members.

The present invention is directed to overcoming one or more of the problems set forth above.

DISCLOSURE OF THE INVENTION

In one aspect of the present invention, a mounting arrangement for a valve member is provided. The mounting arrangement includes a frame that has a preselected configuration. A fluid cylinder is included that has a first end portion mounted to the frame. The fluid cylinder is moveable between a first position wherein the first end portion is positioned in closely adjacent relationship to the frame and a second position wherein the first end portion is moved away from the frame. A valve member is included that has a first end portion having a preselected configuration. The valve member is adapted for engagement with the first end of the cylinder in a manner wherein the preselected portion of the valve is parallel to and closely spaced from the preselected portion of the frame when the fluid cylinder is in its first position.

With a mounting arrangement and valve configuration as set forth above, a load check valve may be mounted directly on the pressurized end of a hydraulic cylinder without the use of interposing hoses or conduits. Further, the valve is configured such that it will match the shape of the closely adjacent frame members. This will allow the two components to "nest" together when the fluid cylinder(s) reaches its extreme travel limits adjacent the frame. This allows the valve to be properly positioned on the fluid cylinder without having to change the existing frame components or the respective relationships between the frame, the boom and the fluid cylinder(s) in order to comply with the various regulations in the various European countries.

BEST MODE FOR CARRYING OUT THE INVENTION

Figure 1:
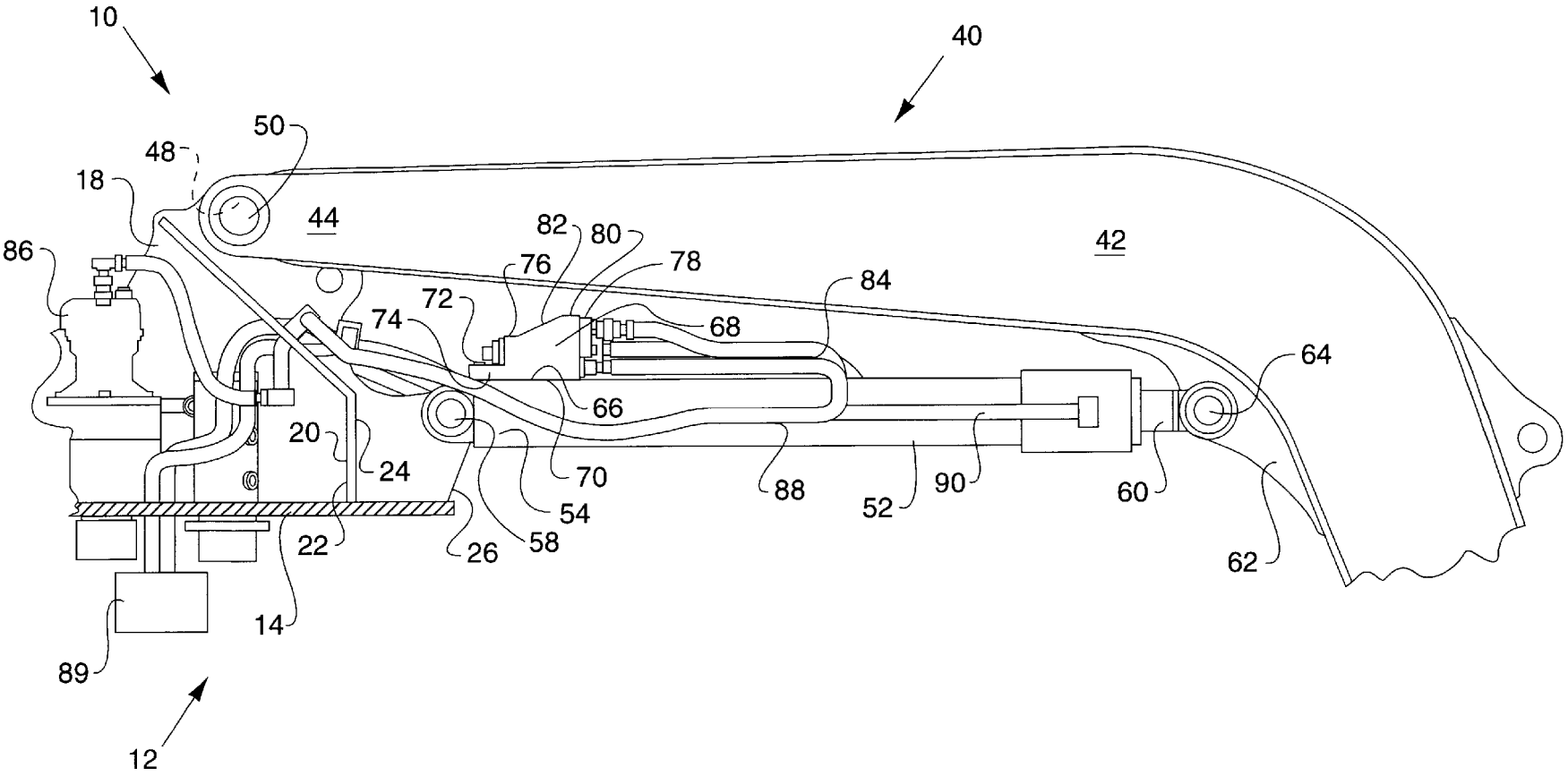
FIG. 1 is a diagrammatic, fragmentary view of a frame portion of a construction machine that embodies the principles of the present invention.

Referring now to the drawings, it can be seen that a portion of a construction machine 10 is shown. The machine 10 includes a frame assembly, generally shown at 12, that has a bottom plate 14 and a pair of side plates 16 and 18 that extend vertically from the bottom plate 14. A laterally directed reinforcing plate 20 extends between and is connected to each of the side plates 16 and 18 . Reinforcing plate 20 defines a first or forward end portion 22 that extends upwardly and rearwardly from the bottom plate. The reinforcing plate defines an angled portion 24 having a preselected configuration at the forward portion thereof.

A pair of mounting brackets 26 extend forwardly of the reinforcing plate 20 and are secured as by welding to both the reinforcing plate and the bottom plate 14. The mounting brackets are spaced between the side plates 16 and 18 and are substantially centered therebetween. Each mounting bracket defines a bore 28 (FIG. 2) therethrough that are aligned with one another along a common axis 30. While a single pair of mounting brackets is shown and described herein, it is to be understood that a pair of mounting brackets may be positioned at spaced locations from one another in the area of each side plate without departing from the principles of the present invention.

Figure 2:
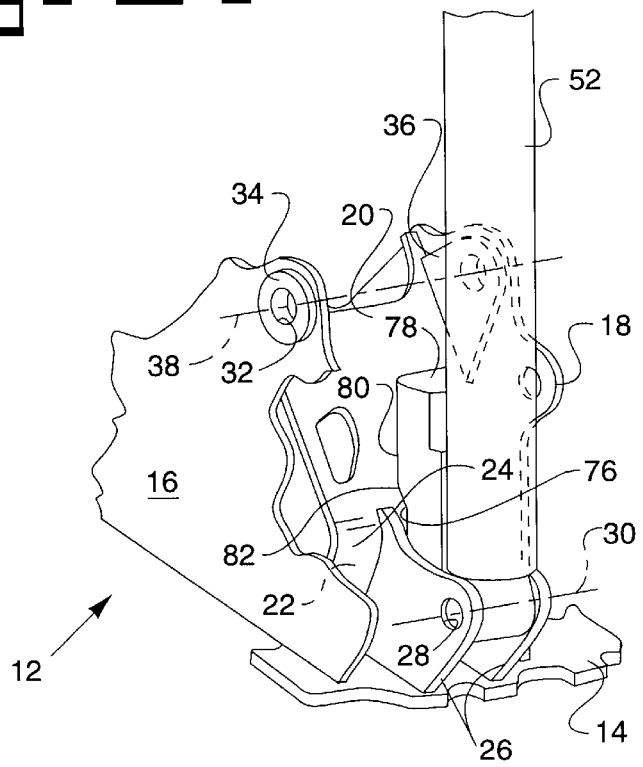
FIG. 2 is a diagrammatic, fragmentary isometric view of the frame portion shown in FIG. 1 shown schematically with some of the components removed to more clearly show the frame portion.

Another pair of aligned bores 32 (FIG. 2) are defined in each of the respective side plates 16 and 18. These bores have an inner and outer reinforcing boss or bracket 34 and 36, respectively, as is best shown in FIG. 2. These bores are aligned with one another on a common axis 38 that is spaced upwardly and to the rear of the axis 30.

A linkage arrangement 40 is mounted to the frame assembly 12 and is adapted to mount a work implement (not shown) thereon. The linkage arrangement 40 has at least one linkage member 42 which, in the present instance, is shown to be the boom member of a hydraulic excavator. The boom member 42 is mounted to the frame assembly at a first end portion 44 thereof and has a second end portion (not shown) that is pivotally connected to a second linkage member, such as a stick member (not shown). The stick member pivotally mounts the work implement for compound movement with respect to the frame assembly. The first end portion 44 defined by the boom member 42 defines a bore 48 that extends from one side of the boom to the other. The width of the first end portion of the boom is sized to be slightly narrower than that between the side plates and is positioned therebetween with the bore 48 aligned with the bores 32 defined in the respective side plates 16 and 18. The aligned bores receive a pin assembly 50 that rotatably mounts the boom member to the frame assembly.

Figure 3:
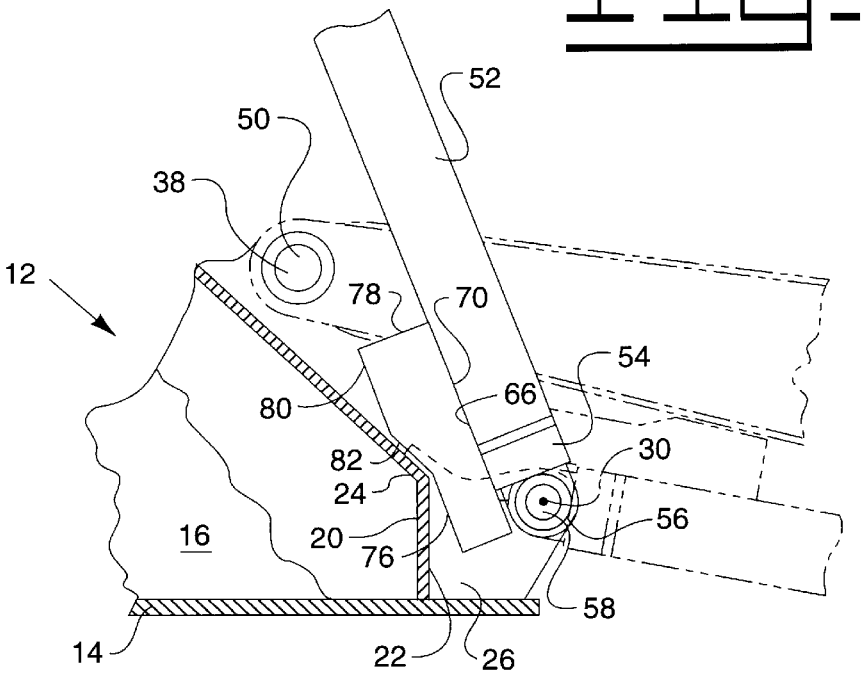
FIG. 3 is a diagrammatic, fragmentary view of the front portion of a construction machine as is schematically shown in FIG. 2 with the components positioned at a maximum travel position.

A fluid actuator 52, such as a hydraulic cylinder, is positioned between the frame assembly 12 and the boom member 42 to move the boom member with respect to the frame assembly. The cylinder 52 has a first, or head end portion 54 that defines a bore 56 that extends therethrough (FIG. 3). The first end portion 54 is positioned between the mounting brackets 26 with the bore 56 aligned with the bores 28 in the mounting brackets. A pin assembly 58 is received within the aligned bores to pivotally mount the cylinder to the frame assembly. A second, or rod end portion 60 of the cylinder is pivotally mounted to the a bracket 62 defined by the boom member 42. A pin assembly 64 rotatably mounts the rod end 60 of the cylinder to the boom member 42.

The cylinder defines a manifold portion 66 that is sufficient for receiving pressurized fluid in a well known manner. In the instant example, the manifold 66 is positioned on the first end portion 54 of the cylinder, on an upward portion thereof as viewed in FIG. 1.

A hydraulic valve member 68, such as a load check valve, defines a mounting portion 70 that interfaces with the manifold 66 defined by the hydraulic cylinder 52. The valve member 68 is mounted to the manifold 66 by a plurality of mounting bolts 72 that extend through a mounting flange 74 defined by the mounting portion. The valve member defines a first generally planar portion 76 that extends substantially parallel to the cylinder and is spaced therefrom a first preselected distance. A second end portion 78 of the valve defines a second, generally planar portion 80 that extends substantially parallel to the cylinder and is spaced therefrom a second preselected distance that is greater than the first preselected distance. An angled surface 82 extends between the two planer surfaces 76 and 80 to define an outer dimension of the valve that has a preselected angled configuration. The angled configuration of the valve, is such that it closely matches the preselected angled portion 24 of the reinforcing plate 20.

A plurality of fluid conduits or hoses extend between the valve member 68 and the hydraulic cylinder 52. A first conduit 84 extends between a pump assembly 86 mounted on the frame assembly 12 and the valve member 68 to deliver pressurized fluid to the valve member. A second conduit 88 extends between the valve member 68 and a fluid reservoir 89, also located on the frame assembly. Yet a third conduit 90 is connected between the rod end 60 of the cylinder 52 and the reservoir.

All pressurized fluid is directed through the valve member 68 to cause extension and retraction of the cylinder 52 to move the cylinder between its maximum positions. In the first position, shown in solid lines in FIG. 3, the cylinder is extended to its maximum position to elevate the boom member 42. In its second position, (shown in phantom lines in FIG. 3) the cylinder is retracted to lower the boom to its lowest position. The boom is operated between these maximum conditions as a portion of the overall control of the total work implement linkage.

While the configuration shown and described herein discloses the use of a single fluid cylinder and associated valve member, it is to be understood that a pair of lift cylinders and valve members could be used as well without departing from the intent of the present invention.

INDUSTRIAL APPLICABILITY

In operation of the linkage arrangement 40, pressurized fluid is directed between the hydraulic pump 86 mounted on the frame assembly 12 and the linkage arrangement 40 as previously described. When it is desirable to elevate the boom to its extreme position, pressurized fluid is directed to the valve member 68 from the pump 86 via conduit 84. The valve member 68 is in direct communication with the head end 54 of the cylinder 52 and the cylinder is extended to its first position. When the cylinder reaches its maximum travel, as is shown in FIG. 3, it can be seen that the valve member 68 is brought into very close proximity to the frame assembly 12. The preselected angled configuration of the valve member 68 is such that it matches the preselected angled configuration 24 of the reinforcing plate 20. In fact, the two preselected configurations are positioned substantially parallel to one another to allow the two components to "nest" within each other, making the maximum use of the available space. When the boom is lowered to its second position, the valve member 68 is positioned on the upper portion of the cylinder so as to remain in a relatively protected area with respect to surrounding structure.

Since the valve member 68 is a load check valve, it is provided with a means, such as a pilot operated sensing system (not shown), to monitor the pressurized fluid that is applied to the cylinder in a well known manner. The valve member 68 also includes a check valve (not shown) to prevent the undesired evacuation of fluid from the head end of the cylinder. Being configured as it is, the valve may now be positioned directly on the cylinder instead of the frame as in past designs. The subject design will allow for immediate compliance with strict regulations in various areas of the world that require the load check valve to be directly attached to the hydraulic cylinder. The specific configuration between the valve and the frame allows this to be accomplished without changes to the members of the frame assembly or the mounting points of the various components.

Other aspects, objects and advantages of this invention can be obtained from a study of the drawings, the disclosure and the appended claims.

I claim:

1. A mounting arrangement for a valve member, comprising:

a frame member having a portion defining a preselected angled configuration;

a fluid cylinder having a first end portion mounted to the frame member and being moveable between a first position wherein the first end portion is positioned in closely adjacent relationship to the portion of the frame member having a preselected angled configuration and a second position wherein the first end portion is moved away from the frame member; and a valve member having a first housing wall having a mounting portion and a second housing wall having a preselected angled configuration that is spaced from said first housing wall, said mounting portion of the valve member being adapted for engagement with the first end portion of the fluid cylinder in a manner wherein the valve member is positioned with the preselected angled configuration of the valve member parallel to and closely spaced from the preselected angled configuration defined by the frame member when the fluid cylinder is in its first position.

2. The mounting arrangement as set forth in claim 1 wherein the fluid cylinder defines a pressurized fluid receiving manifold that is adapted to mount the valve member.

3. The mounting arrangement as set forth in claim 1 wherein the frame member is defined by the frame of a construction machine having a frame assembly having a pair of side plates and a reinforcing plate positioned between said side plates that defines said preselected angled portion, and a linkage arrangement having a first end portion pivotally mounted between said side plates and a second end portion having a work implement mounted thereon, said linkage arrangement being adapted for compound movement of the work implement with respect to the frame assembly.

4. The mounting arrangement as set forth in claim 3 wherein the hydraulic excavator includes a linkage arrangement for mounting a work implement to the hydraulic excavator.

5. The mounting arrangement as set forth in claim 3 wherein the fluid cylinder is a lift cylinder and the first end portion thereof is pivotally mounted to the excavator frame and a second end portion is pivotally mounted to the linkage arrangement and introduction of pressurized fluid into the first end portion of the lift cylinder will cause the movement of the linkage arrangement toward the excavator.

6. The mounting arrangement as set forth in claim 1 wherein the preselected angled configuration of the valve member includes a first, substantially planar portion that extends substantially parallel to the fluid cylinder and is spaced therefrom a first preselected distance and a second, substantially planar portion, that extends substantially parallel to the fluid cylinder and is spaced therefrom a second preselected distance that is greater than the first preselected distance, and an angled portion that extends between the first and second planar portions.

7. The mounting arrangement as set forth in claim 1 wherein a plurality of conduits communicate the valve member with a source of pressurized fluid mounted on the frame.

* * * * *